United States Patent [19]

Bliss

[11] 4,062,487

[45] Dec. 13, 1977

[54] CARTON CLOSURE

[75] Inventor: Robert A. Bliss, St. Paul, Minn.

[73] Assignee: Hoerner Waldorf Corporation, St. Paul, Minn.

[21] Appl. No.: 751,846

[22] Filed: Dec. 17, 1976

[51] Int. Cl.[2] ..... B65D 5/46; B65D 5/72; B65D 5/10

[52] U.S. Cl. ..... 229/52 B; 229/17 G; 229/41 C; 229/39 R

[58] Field of Search ..... 229/17 G, 52 B, 41 C, 229/39 R

[56] References Cited

U.S. PATENT DOCUMENTS

| | | | |
|---|---|---|---|
| 2,900,124 | 8/1959 | Leone | 229/52 B |
| 3,141,597 | 7/1964 | Palmer | 229/17 G |
| 3,172,594 | 3/1965 | Kuchenbecker | 229/17 G |
| 3,255,950 | 6/1966 | Marcouly et al. | 229/52 B |
| 3,269,640 | 8/1966 | Arneson | 229/41 C X |
| 3,526,352 | 9/1970 | Swett | 229/41 C X |
| 3,700,161 | 10/1972 | Bundy | 229/41 C |
| 3,776,108 | 12/1973 | Nock | 229/52 B X |
| 3,827,623 | 8/1974 | Arneson | 229/39 R |
| 3,977,594 | 8/1976 | Swan | 229/41 C X |

FOREIGN PATENT DOCUMENTS

| | | | |
|---|---|---|---|
| 1,422,235 | 11/1965 | France | 229/52 B |

*Primary Examiner*—Davis T. Moorhead
*Attorney, Agent, or Firm*—Jerry F. Best

[57] ABSTRACT

A unique closure flap configuration for the end of a paperboard container.

4 Claims, 21 Drawing Figures

CARTON CLOSURE

BACKGROUND OF THE INVENTION

1. Field of the Invention

This disclosure relates generally to closures for paperboard cartons, and has particular utilization with cartons which have recessed tops or those designs which are either multiple sided or are non-rectangular. The disclosure also relates to recessed closures which have a handle which is integrally formed therein.

2. Description of the Prior Art

The use of carrying handles in cartons for products such as carry-out foods is highly desirable. Similarly, where the carton is to be reused or employed as a storage container it is desirable to have a handle formed with the closure. There are many styles of handles for rectangular containers, but for non-rectangular four-sided containers or containers with more than four sides there is a need for an integral carrying handle formed as a part of the closure. Examples of six-sided containers are to be found in U.S. Pat. No. 3,977,594 and the references cited therein.

SUMMARY OF THE INVENTION

Integral handle arrangement for a recessed carton closure wherein two triangular sections are hinged along the hypotenuse of the triangles and are hinged to closure flaps along the top edges of the side walls of the carton, the points of the triangle extending across the top of the carton.

DETAILED DESCRIPTION OF THE PREFERRED EMBODIMENT

Figure 1:
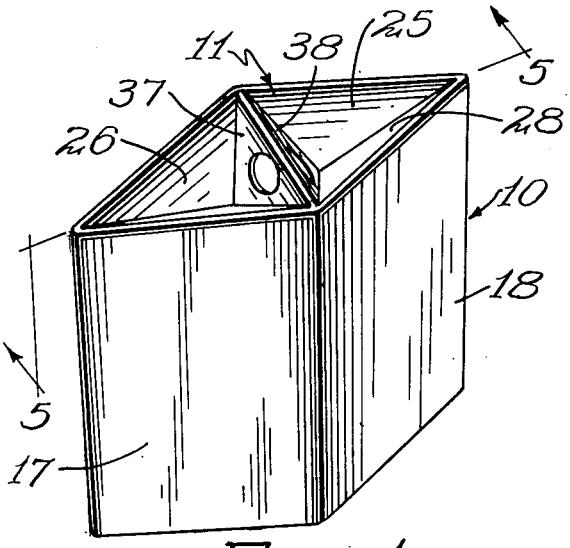
FIG. 1 is a perspective view of a four-sided container having a closure embodying the present invention.
Figure 2:
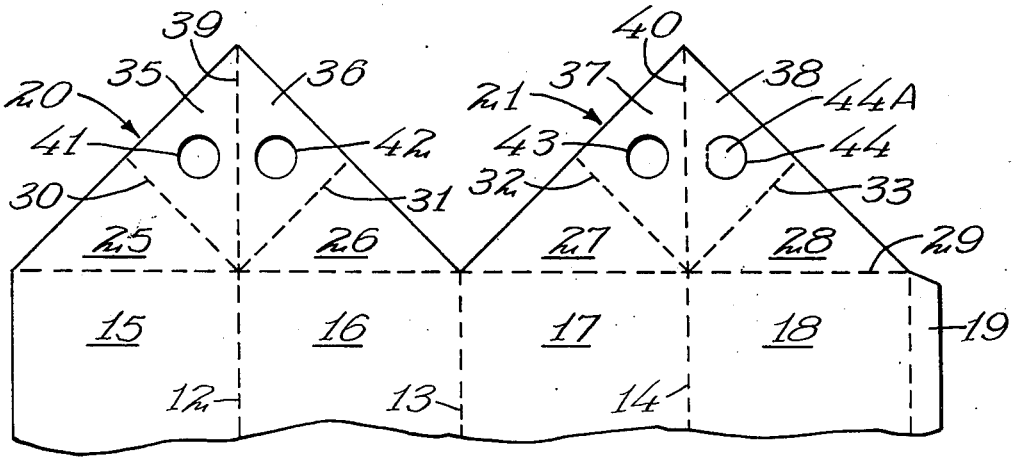
FIG. 2 is a plan view of a portion of a blank adapted to be erected into a carton having a closure like the one shown in FIG. 1.

The limiting factors on the geometry of the containers which may utilize the present invention are that the container must have an even number of sides since the handle structure extends between opposing corners or apexes and there should be symmetry on either side of the handle as it extends across the carton. As can be seen in FIG. 1, a four-sided carton 10 may be used which has a top recessed closure shown generally as 11. The carton is erected from a blank such as that shown in FIG. 2 and while the bottom closure is not of particular interest in this invention, a typical bottom closure may be seen in FIG. 7 and will be described later. The four side walls of the container 10 are shown in FIG. 2 as rectangular and connected along vertical hinge lines 12, 13 and 14. These connect the adjacent side wall panels 15, 16, 17 and 18 and in their erected tubular form are connected by a manufacturer's joint flap 19.

The top closure 11 is erected from two large triangular flaps shown as 20 and 21 in FIG. 2. There are four uniformly sized triangular sections 25, 26, 27 and 28 which are defined by the outer edges of the blank and along the bottom by the horizontal hinge line 29. It should be noted that these four triangles have as their hypotenuse a side equal to the lateral width of the carton 10. As can be seen in FIG. 1 this insures complete coverage of the end of the carton 10. The side of each of the four triangles 25 through 28 which is within the closure blanks 20 and 21 is shown in the drawings as being defined by a hinge line 30, 31, 32 and 33. In the particular embodiment shown these hinge lines are at right angles to the outside edges of the blank but it should be understood that that need not be the case and that for a carton with any particular geometry, that angle may be varied to affect the depth of the closure below the top surface of the container 10.

Figure 3:
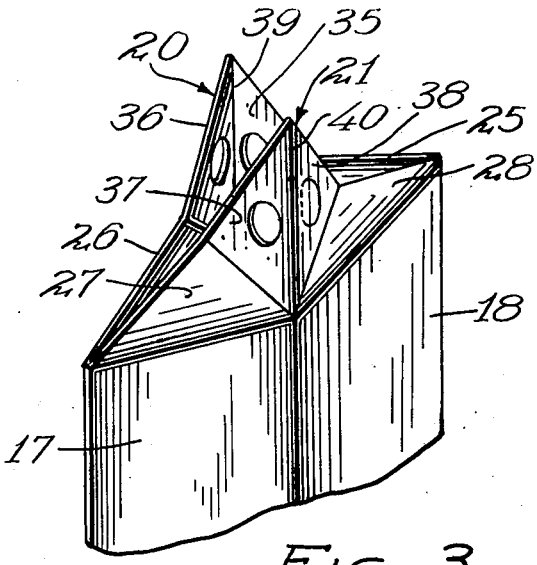
FIG. 3 is a perspective view of a container such as shown in FIG. 1 illustrating the operation of the closure.
Figure 4:
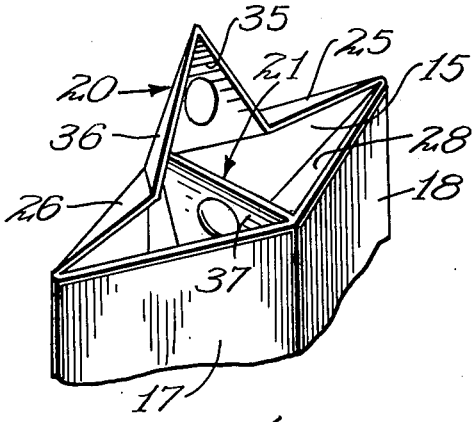
FIG. 4 shows the closure of FIG. 3 partially erected.
Figure 5:
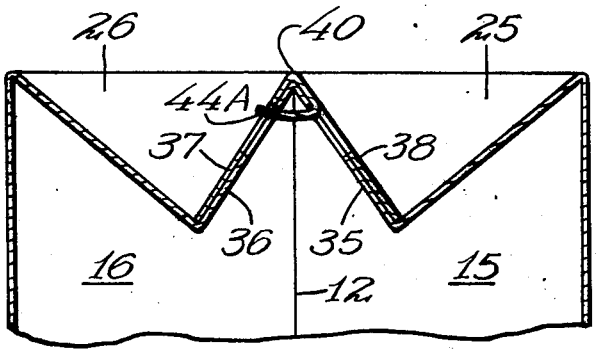
FIG. 5 is a side elevation section view of the assembled closure taken along section lines 5—5 in FIG. 1.

The particular embodiment illustrated is of a four-sided carton with equal sides. Utilizing the particular height shown and the right angle configuration of those hinge lines 30 through 33 provides a diamond shaped carton with a rather deep, recessed handle. The remainder of the closure blanks 20 and 21 consist of two equal triangular sections 35, 36, 37 and 38 which have as one side the hinge lines 30 through 33 and have a common hinge line 39 and 40 which extends normally from the top edge of the carton blank and is perpendicular to the hinge line 29. The triangular handle sections also have formed therein die cut apertures 41, 42 and 43 with a die cut hinged section of similar shape 44 in the last section 38. FIGS. 3 and 4 illustrate the assembly of the closure and it should be noted that the geometry of the blank is calculated such that the length of the hinge lines 39 and 40 defines the width of the container 10. The two handle sections lie in overlapping relationship as can be seen in FIG. 5 and the die cut apertures 41 through 44 align to provide holes for easy carrying. The tab 44A is pressed through the holes to help retain the closure in alignment and in position. If the asthetics of the closure are desired without handle utilization, the holes may, of course, be eliminated.

Figure 8:
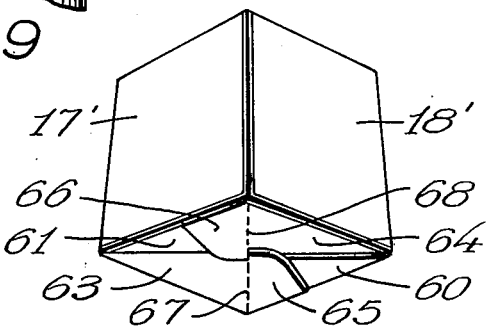
FIG. 8 is a perspective view showing the bottom of a container such as that shown in FIGS. 1 and 6.

The alternate embodiment illustrated in FIGS. 6 through 12 illustrates a locking feature which consists of die cut tabs 50 and 51 which extend beyond the end of one of the pairs of triangular handle sections 52 and 53 and are designed to be inserted into slots 54 and 55 which are cut along the hinge lines 30A and 31A in the blank. For ease of understanding the numbering convention has been retained in FIGS. 6 through 12. The above closure arrangement is one which in the blank consists of a flap 60 and 61 hingedly connected along the horizontal fold line 62 to the bottom of the side wall panels 15' and 17', respectively. Flaps 63 and 64 are hingedly connected along the bottom edges of the alternate side wall panels 16' and 18' and have hingedly connected thereto a small glue flap 65 and 66 connected along the hinge lines 67 and 68. The assembled closure is illustrated in FIG. 8 and it may be seen that the glue flaps 65 and 66 overlap the other flaps 60 and 61 and the large flaps 63 and 64 are formed in extent greater than ½ the width of the carton so that they engage as seen in FIG. 8.

Figure 6:
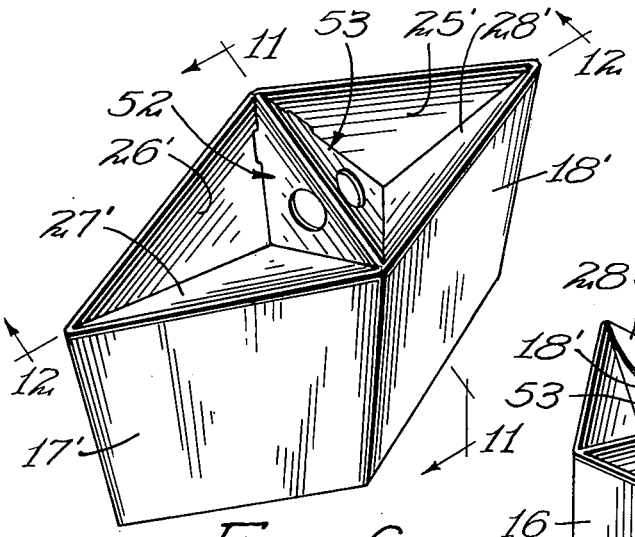
FIG. 6 is a perspective view of an alternate embodiment of a closure similar to the one shown in FIG. 1.
Figure 10:
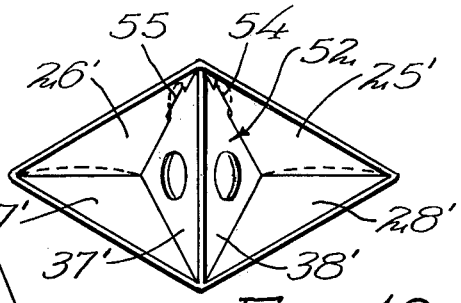
FIG. 10 is a top plan view of the container shown in FIG. 6.
Figure 9:
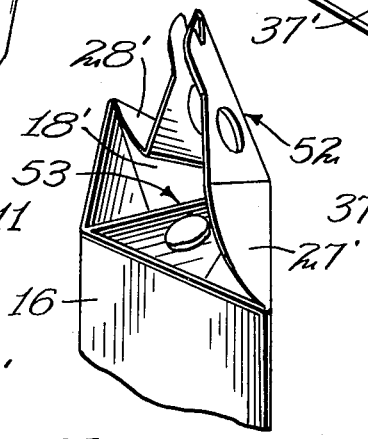
FIG. 9 is a perspective view of the upper portion of the container of FIG. 6 illustrating the assembly of the closure.
Figure 11:
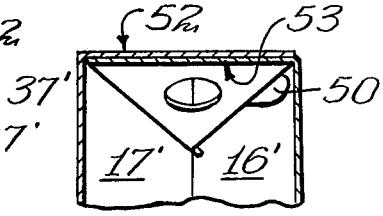
FIG. 11 is a side elevation section view taken along section lines 11—11 in FIG. 6.
Figure 12:
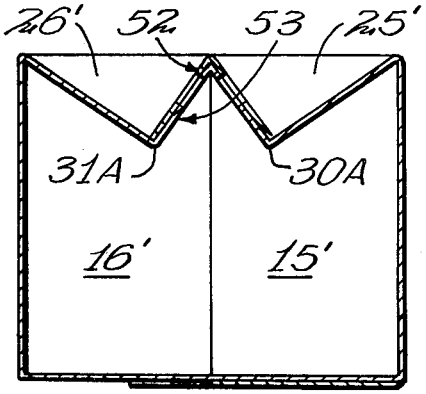
FIG. 12 is a side elevation section view taken along section lines 12—12 in FIG. 6.
Figure 7:
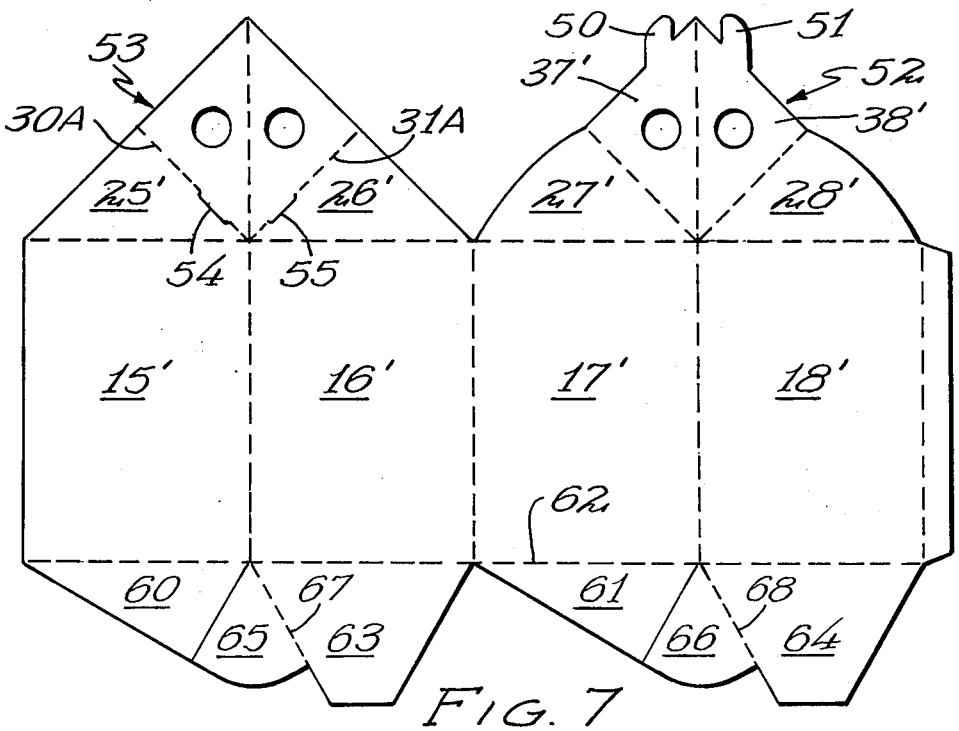
FIG. 7 is a plan view of a blank adapted to be erected into the container shown in FIG. 6.

One additional feature illustrated in the blank on FIG. 7 and the carton of FIG. 6 is that the edge of the triangular sections in the top closure may be outwardly rounded as in 27' and 28' to provide some degree of overlap at the edges in the assembled structure to help seal the carton, this overlapping seen best in FIG. 10.

Figure 13:
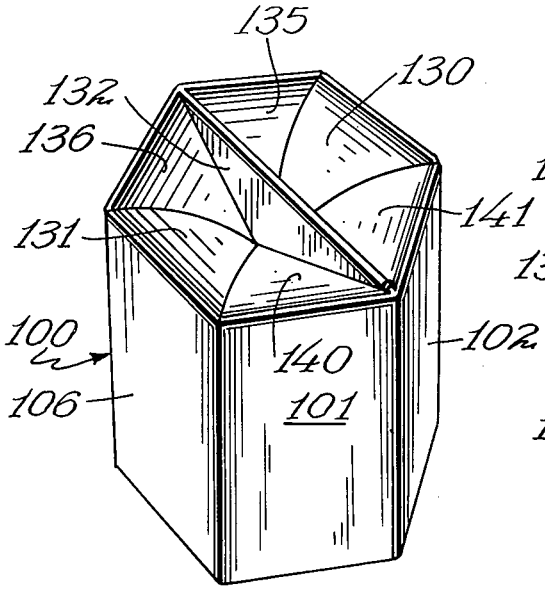
FIG. 13 illustrates an alternate embodiment and is of a six-sided container with a closure embodying the present invention.
Figure 14:
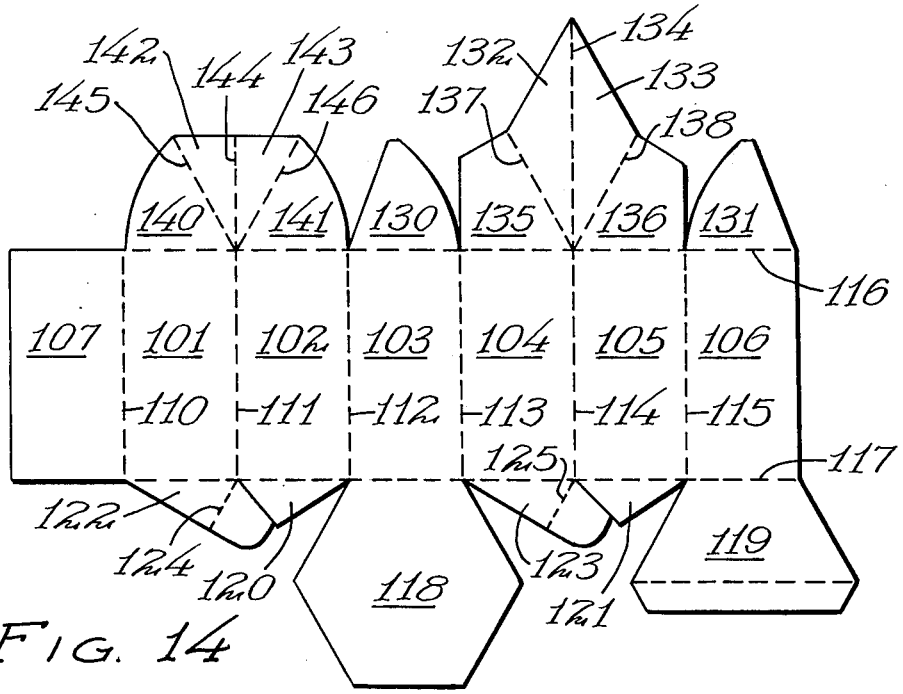
FIG. 14 is a plan view of the blank adapted to be erected into the container shown in FIG. 13.
Figure 15:
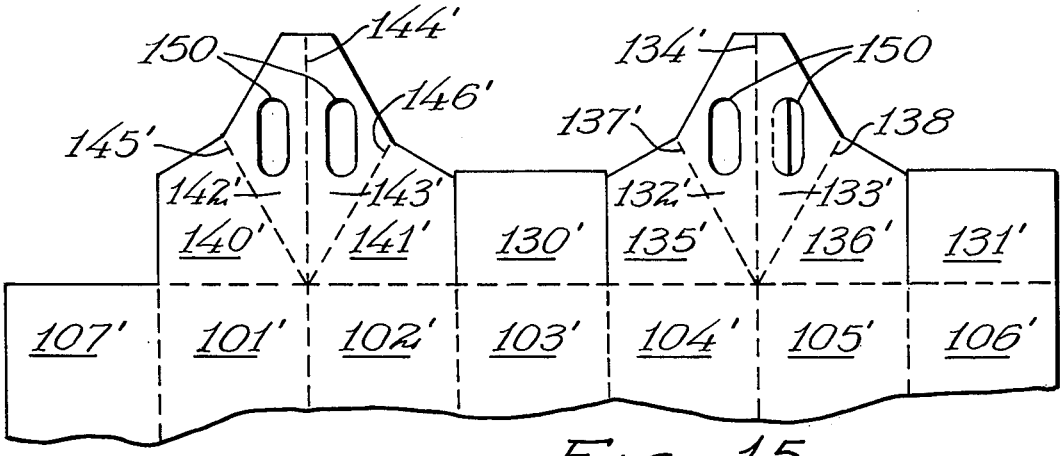
FIG 15 is an alternate embodiment of the top closure flaps of the blank of FIG. 14.

As previously mentioned, the present invention may be utilized in any container having sides which are even in number, and FIG. 13 illustrates a six sided or hexagonal container utilizing the present invention. The blanks shown in FIGS. 14 and 15 are for a typical hexagonal container and include six rectangular side wall panels 101, 102, 103, 104, 105 and 106 along with a glue flap 107, all connected along vertical hinge lines 110, 111, 112, 113, 114 and 115. The top and bottom edges of the blank are defined by horizontal hinge lines 116 and 117. The bottom closure is of a conventional style and similar to that employed for the previously described four sided carton 10, and includes two large glue flaps, the first 118 being in size and shape substantially equal to the cross sectional area of the carton 100. The second is 119 which is a flap positioned on the opposite side of the container 100, may be of any size but is intended to be glued to the flap 118 and together be the inner portion of the closure for the container 100. Two small triangular flaps on opposite sides of the container 100 are shown as 120 and 121 which act together with adjacent flaps 122 and 123 having fold lines 124 and 125 formed therein much in the same way as the adjacent pairs of flaps shown in FIG. 7 to interlock and form the outer bottom for the container 100.

Figure 16:
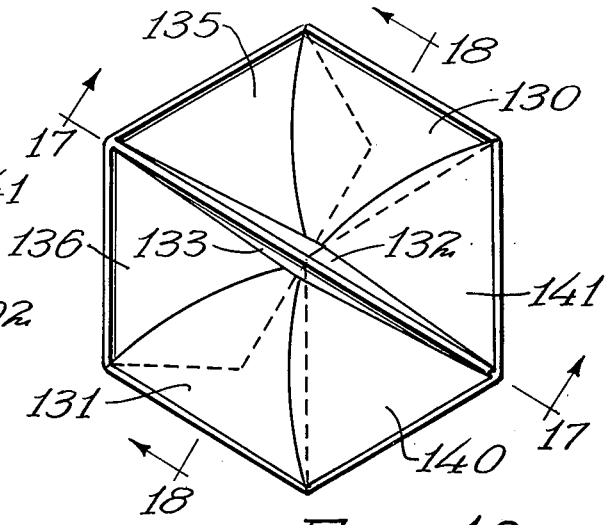
FIG. 16 is a top plan view of the container shown in FIG. 13.
Figure 17:
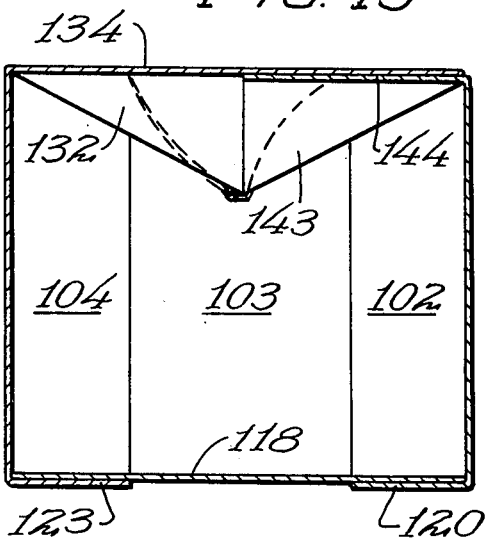
FIG. 17 is a side elevation section view of the assembled carton taken along section lines 17—17 in FIG. 16.
Figure 18:
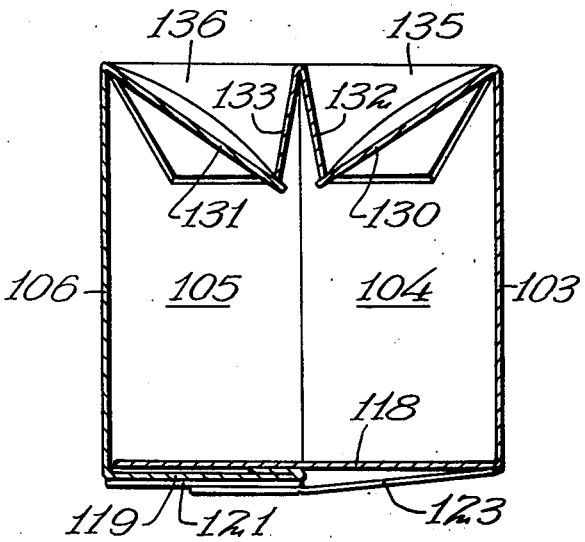
FIG. 18 is a side elevation section view taken along section lines 18—18 in FIG. 16.
Figure 19:
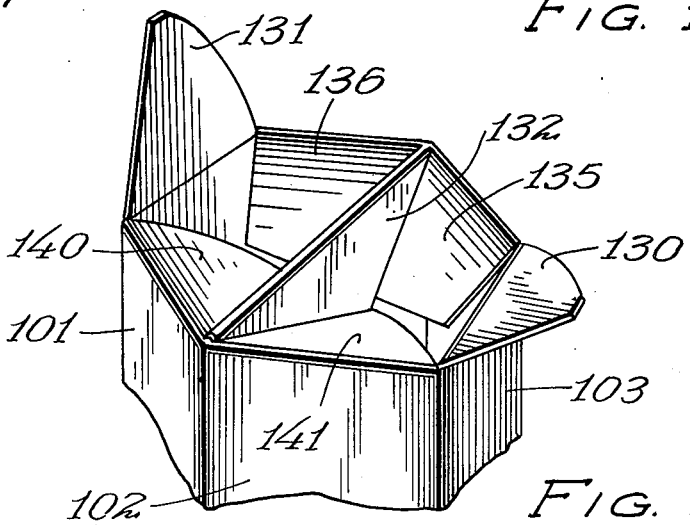
FIG. 19 is a perspective view of the closure shown in FIG. 13 illustrating the assembly thereof.

Along the top edge of the blank in FIG. 14 are hingedly attached two small rectangular filler sections 130 and 131 which are used to insure coverage over the top of the container not covered by the remaining handle sections. In addition, there are two large handle sections, a first of which is the outer handle and includes two triangular shaped handle sections 132 and 133 connected along their hypotenuse by the vertical fold line 134 which is an extension of the fold line 114. These triangles have a hypotenuse formed in length a distance equal to the dimension of the container 100 across opposing points of the polygon. These are connected to two filler flaps 135 and 136 along angled fold lines 137 and 138. The closure may be formed with another similar inner closure handle section attached to the top edges of the side panels 101 and 102 or it may be formed as shown, without triangular sections which extend the complete breadth of the container 100, since it is covered by the outer handle sections 132 and 133. This consists of two sections 140 and 141 with smaller cut off triangles 142 and 143 hinged together along a common fold line 144 which is an extension of the fold line 111 and to the filler flaps 140 and 141 along angled fold lines 145 and 146. A degree of overlap between adjacent filler sections may be obtained by rounding out the edges of the flaps and produces the result seen in FIG. 16. The assembly of the blank shown in FIG. 14 is illustrated in FIG. 19 and shows that the two triangular handle sections are placed in position initially and the smaller filler flaps are pressed down so that the straight edge underlies the curved edge of the adjacent filler flaps and the curved edge of the sections overlies the filler sections of the outer handle area 135 and 136. If desired the inner and outer handle sections may be glued together.

Figure 20:
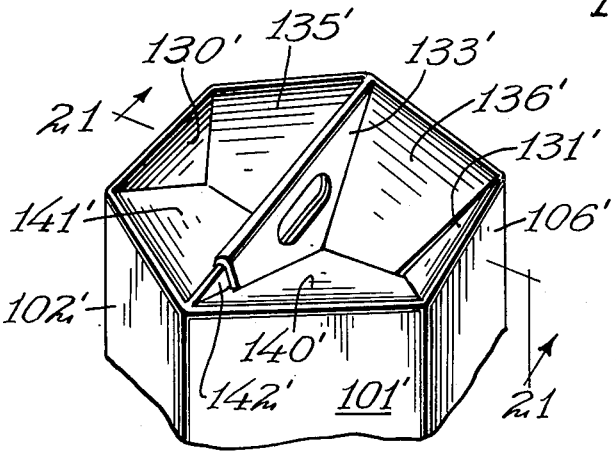
FIG. 20 is a perspective view of the closure of a sixsided container illustrating the alternate embodiment to be derived utilizing the blank of FIG. 15.
Figure 21:
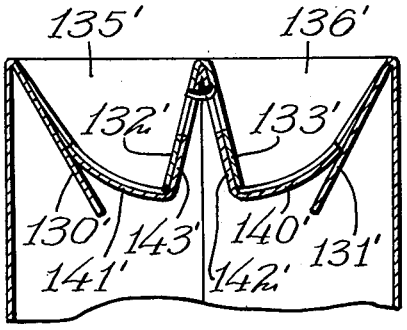
FIG. 21 is a side elevation section view taken along section lines 21—21 in FIG. 20.

An alternate embodiment is illustrated in FIG. 15 illustrating how similar shaped handle sections may be employed with die cut apertures to place the fingers or hand when carrying the carton 100. Similar numbering sequence is used for convenience and the numbers are shown as prime numbers. The apertures are cut in such a manner that they overlap and are numbered 150. A similar assembly procedure is used and the resulting configuration is seen in FIGS. 20 and 21.

I claim:

1. A carton blank for a four-sided carton having a recessed double thickness handle formed as a part of the top closure, said blank comprising:

four rectangular side wall panels of equal size positioned in lateral alignment and connected by vertical fold lines, said side panels defined along their top and bottom edges by horizontal fold lines;

bottom closure flaps connected along said bottom edge of said side wall panels;

a top closure for said blank connected along the top edge of said blank including a first triangular handle section, said triangular section being formed as an isosceles triangle having a base equal to the width of a first adjacent pair of said side wall panels and having a center fold line extending vertically from the apex of said triangle to the point of intersection of said top edge fold line and the vertical hinge line connecting said first pair of adjacent side wall panels, said first triangular handle section having a slot cut on each side of said vertical fold line and positioned along said diagonally positioned fold lines;

a pair of fold lines extending diagonally from the point of intersection of said top edge hinge line and said hinge line connecting said first pair of adjacent side wall panels and intersecting the outer edges of said first triangular handle section;

a second triangular handle section substantially similar in size and configuration to said first triangular handle section connected along the top edge of the remaining two adjacent side wall panels;

a pair of insertable tabs formed as a part of and extending vertically from said second triangular handle section adjacent the apex of said second section, said tabs formed in width substantially equal to or slightly less than the length of said slots; and wherein die cut apertures are formed in that portion of each of said triangular handle sections on either side of each vertical fold line and above each of said diagonally positioned fold lines.

2. A blank for a six-sided carton having a double thickness recessed carrying handle, said blank comprising:

six substantially equal rectangular side wall panels arranged laterally and defined along their top and bottom edge with hinge lines and connected to one another along vertically oriented fold lines;

closure flaps connected along said bottom hinge line to said side wall panels adapted to be folded into a closure in an erected carton;

a filler section flap hingedly connected along the top edge of a first of said side wall panels positioned at a first lateral edge of said blank;

a second filler section flap connected to a second of said side wall panels, said second side wall panel being spaced from said first side wall panel by a pair of adjacent intermediate side wall panels;

said pair of side wall panels intermediate said first and second side wall panels having connecting along the top edge thereof a first closure handle section, said section including a pair of isosceles triangles positioned with the hypotenuse of each in juxtaposition and colinear with the vertical fold line positioned between said adjacent side wall panels;

the downwardly positioned apex of each of said triangles positioned at the point of intersection between said vertical fold line connecting said adjacent side wall panels and said upper horizontal hinge line;

each of said triangles connected along the downward facing leg thereof by a fold line to a pair of quadrilateral filler flaps which are in turn hinged along the top edge of each of said respective adjacent side wall panels; and the remaining two adjacent side wall panels positioned along the remaining open lateral end of said blank having hingedly connected along the top edge thereof a second handle section including quadrilateral filler flaps of similar shape and size to said flaps forming a part of said first closure handle section, and at least a portion of a pair of isosceles triangles equal in size and shape to those in said first closure handle section.

3. The blank of claim 2, wherein said second handle section is formed equal in size and shape to said first handle section.

4. The blank of claim 3, wherein die cut apertures are formed on either side of said vertically oriented hypotenuses in each carrying handle section.

* * * * *